US010045645B2

(12) United States Patent
Kim

(10) Patent No.: US 10,045,645 B2
(45) Date of Patent: Aug. 14, 2018

(54) PORTABLE CUP HOLDER

(71) Applicant: Yu Sin Kim, Gwangju (KR)

(72) Inventor: Yu Sin Kim, Gwangju (KR)

( * ) Notice: Subject to any disclaimer, the term of this patent is extended or adjusted under 35 U.S.C. 154(b) by 0 days.

(21) Appl. No.: 15/362,298

(22) Filed: Nov. 28, 2016

(65) Prior Publication Data

US 2018/0146809 A1 May 31, 2018

(51) Int. Cl.
*A47G 23/02* (2006.01)
*B65D 71/00* (2006.01)

(52) U.S. Cl.
CPC ..... *A47G 23/0208* (2013.01); *B65D 71/00* (2013.01)

(58) Field of Classification Search
CPC .... A47G 23/02; A47G 23/0208; B65D 71/00; B65D 71/004; B65D 71/40; B65D 71/48
USPC ..... 206/151, 158, 172, 193, 194, 199, 427; 294/87.2
See application file for complete search history.

(56) References Cited

U.S. PATENT DOCUMENTS 2,581,100 A * 1/1952 Hennessy ..... B65D 81/368 206/194
4,196,807 A * 4/1980 Brom ..... B65D 71/0007 206/197
5,267,644 A * 12/1993 Tsao ..... B65D 71/48 206/151
5,609,379 A * 3/1997 Harrelson ..... B65D 71/44 206/192
5,624,024 A * 4/1997 Miess ..... B65D 71/004 206/172
5,738,217 A * 4/1998 Hunter ..... B65D 71/48 206/194
5,803,264 A * 9/1998 Gersten ..... B65D 71/004 206/194
5,927,502 A * 7/1999 Hunter ..... B65D 71/48 206/194
6,834,762 B2 * 12/2004 Krisko ..... B65D 71/0022 206/162
2013/0284616 A1 * 10/2013 Anderson ..... B65D 71/40 206/193

FOREIGN PATENT DOCUMENTS

DE 202014105081 U1 * 1/2016 ..... B65D 71/004
GB 1241438 A * 8/1971 ..... B65D 71/48

* cited by examiner

*Primary Examiner* — Byron Gehman
(74) *Attorney, Agent, or Firm* — Roberts Mlotkowski Safran Cole & Calderon P.C.

(57) ABSTRACT

The invention provides a portable cup holder for carrying a cup with, for example, take-out coffee. The portable cup holder is made with a minimum amount of material that may be folded rapidly and easily, and comprises a bottom portion 1 forming a bottom surface through which a cup opening 3 is formed, a fixing portion 4 connected to top and bottom ends of the bottom portion 1 and folded vertically, a rising portion 7 folded and disposed vertically at right and left ends of the bottom portion 1, a top portion 2 connected to the rising portion 7 forming a top surface and including the cup opening 3*a*, and a handle portion 10 folded vertically upwards at the top portion 2 that forms a handle.

7 Claims, 7 Drawing Sheets

PORTABLE CUP HOLDER

FIELD OF TECHNOLOGY

The invention relates to a portable cup holder for carrying around a cup with drinks such as coffee, for example, in case of taking out coffee, etc.

BACKGROUND OF INVENTION

[Document 1] Korean Patent Application Publication No.: 10-2004-0084412.

Pub. Date: Oct. 6, 2004

[Document 2] U.S. Pat. No. 9,440,573 (Issue Date Sep. 13, 2016)

The Prior Art Document 1 teaches a cup holder for automobile with a structure having a tray for supporting a cup and a hole formed through the tray, so as to receive a cup by inserting it in the hole.

The Prior Art Document 2 teaches a cup holder assembly, which includes a pair of planar bodies each defining a rim, and a pair of fabric pouches that are each attached to one of the rims. The planar bodies are pivotably attached to each other and are configured such that, in a folded position, the rims are stacked and the fabric pouches are nested within each other, and in a deployed position, the rims and fabric pouches are side-by-side.

Conventional cup holder structure that relates to the invention is as follows. For example, a cup inserted to a ring-shaped cup holder is provided to a customer for preventing hot portion from touching in the case of only one cup for take-out of coffee. However, in order to pack two or more of them, a portable cup holder for take-out that is made of paper material has been used. However, lots of paper material is needed for the cup holder and the cup tends to be detached or escape from the cup holder due to the weight of contents of the cup when handled in wrong ways. Also, the contents in the cup held in the cup holder may be spilled, for the cup could be shaken in the inner space of the cup holder.

Also, as for the cup holders of such paper material, the folding assembly process is inconvenient and time-consuming and the structure makes the manufacturing processes complicated, resulting in an increase of manufacturing cost. Also, since the volume of the cup holder is big, it is not easy to load, transport, and store, resulting in an increase of logistic cost.

DESCRIPTION OF INVENTION

Problems to Solve

The invention, is to solve the above problems and to provide a stable cup holder, which needs minimum amount of paper material and does not have problems of sagging down or being dislocated due to the weight of contents in the cup.

Also, the invention, is to provide a cup holder, which can be made rapidly and easily by simple folding thanks to the simple structure, and can be made by simple manufacturing process due to the simple structure, resulting in low manufacturing cost.

Solutions to Problems

A portable cup holder made with minimum amount of material and by folding rapidly and easily, the portable cup holder comprises a bottom portion 1 forming a bottom surface and through which a bottom cup opening 3 is formed, a fixing portion 4 connected to top and bottom ends of the bottom portion 1 and folded vertically, a rising portion 7 folded and disposed vertically at right and left ends of the bottom portion 1, a top portion 2 connected to the rising portion 7 forming a top surface and forming the top cup opening 3*a*, and a handle portion 10 folded vertically upwards at the top portion 2 and forming a handle, and in the fixing portion 4 is formed an inserting groove 5, wherein in a bottom portion of the handle portion 10 is formed a fixing piece 14, and wherein the fixing piece 14 is configured to be inserted into the inserting groove 5 of the folded fixing portion 4.

As other features of the invention, in the inserting groove 5 is formed a cutting portion 19 extending outwards to an outside of the inserting groove 5, a circumference of the bottom cup opening 3 is configured with corrugated portions 20 having a circumferential surface of corrugated shape, the circumference of the corrugated portions 20 is smaller than a circumference of the top cup opening 3*a* at the top portion 2, a cutting portion 21 is formed in a radial direction of the circumference of the corrugated portions 20, any one of a slip-preventing surface 23 formed by a slip-preventing material or dots 22 having protruding shapes are formed between one cutting portion 21 and another cutting portion 21, and when the top portion 2 is folded, center axes vertical to the top cup opening 3*a* formed in the top portion 2 and the bottom cup opening 3 formed in the bottom portion 1 are not coincided. Other additional inventive features are going to be described in the Detailed Description of Invention.

Effects of Invention

According to the invention, a stable cup holder is provided, which can be made with minimum amount of paper material and is free from falling down or being dislocated due to the weight of contents in the cup, for the circumference of the cup opening 3 for latching the cup supports the cup doubly.

Also, according to the invention, the cup may be fixed in place so as not to be slipped off the cup holder or moved, preventing the contents of the cup from escaping and enabling a user to carry around the cup stably. Furthermore, the cup holder can be made by rapid and easy folding thanks to the structure simpler than conventional paper cup holders, and the manufacturing cost can be reduced maximally, resulting from the simple manufacturing process due to the simple structure.

DETAILED DESCRIPTION OF EMBODIMENTS OF INVENTION

The invention, is going to be described referring to the attached drawings below.

Figure 1:
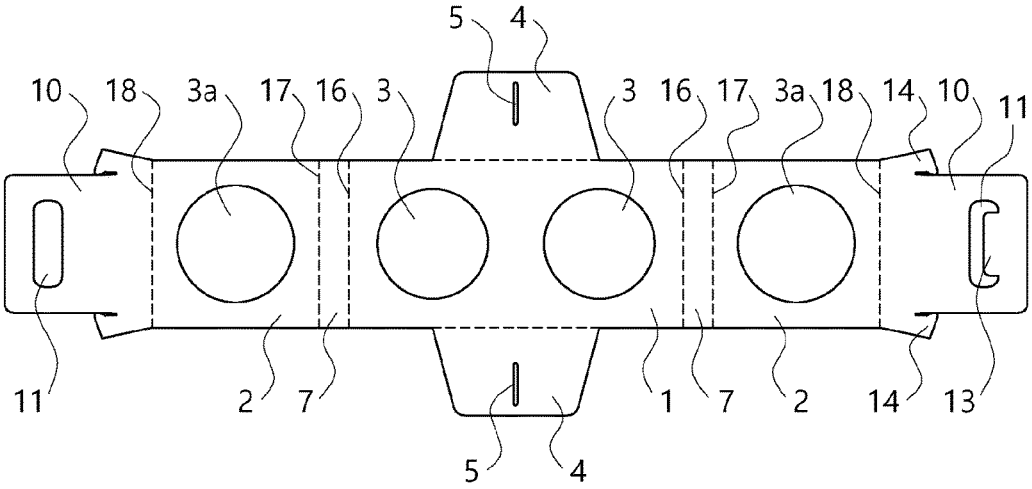
FIG. 1 is a planar figure of a cup holder according to the invention.

First, FIG. 1 is a planar figure of a cup holder according to the invention.

As shown, when viewing the invention, on a plane, on right and left sides of the bottom portion 1 is formed the top portion 2, and there are formed the top cup openings 3*a* respectively. On top and bottom ends of the bottom portion 1 are formed the fixing portions 4, and in the fixing portion 4 is formed the inserting groove 5. Between the bottom portion 1 and the top portion 2 is formed the rising portion 7. In the top portion 2 is connected and formed the handle portion 10. In the handle portion 10 on both ends of the right and left is formed the handle hole 11, and in one of the two is formed the folding piece 13. In the top and bottom edges of the handle portion 10 connected to the top portion 2 is formed a fixing piece 14 in a shape of sort of hook or arrow. The reason for making in such shapes, as described below, is for inserting stably in the inserting groove 5 of the fixing portion 4, so as not to be dislocated easily. On the bottom portion 1 and the top portion 2 are formed the first, second, and third folding portions 16, 17, 18, so as to be foldable. The first, second, and third folding portions 16, 17, 18 may be made so as to be folded easily by adding a weak pre-cut line or dot-shaped through-holes.

Figure 2:
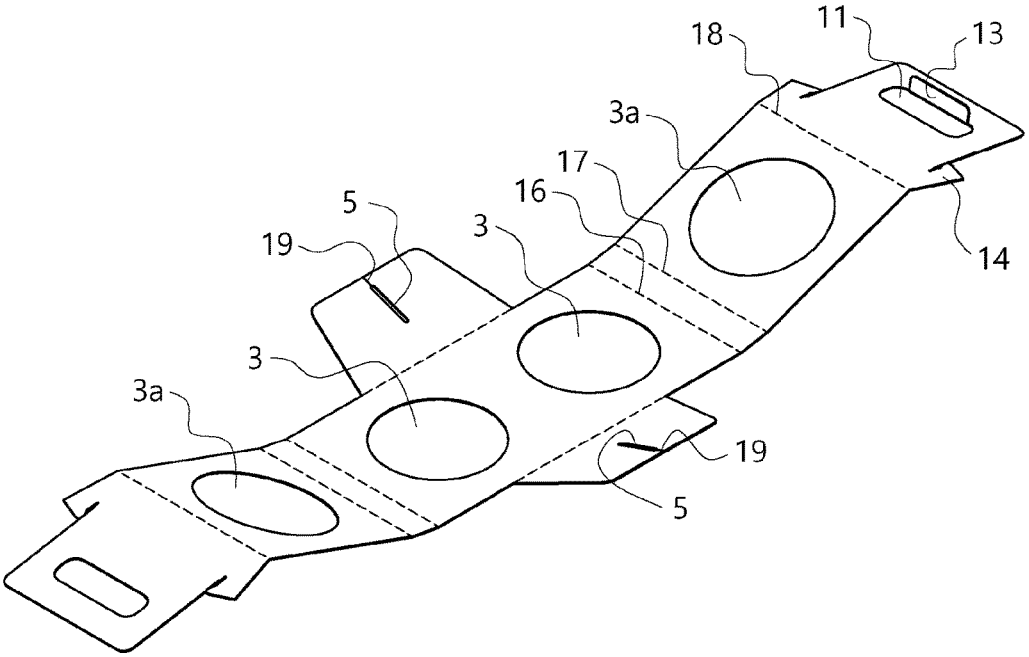
FIG. 2 is a state diagram with first, second, and third folding portions 16, 17, 18 folded slightly.

A pattern of folding is described below according to the structure of the planar figure of FIG. 1. FIG. 2 shows a state of folding the first, second, and third folding portions 16, 17, 18 and also the folding piece 13. Here, it is possible to provide a cutting portion 19 disposed outwards extending with the inserting groove 5. The cutting portion 19 may be made so as to be cut easily by adding a pre-cut line or line of through-holes or with pre-cutting line.

Figure 3:
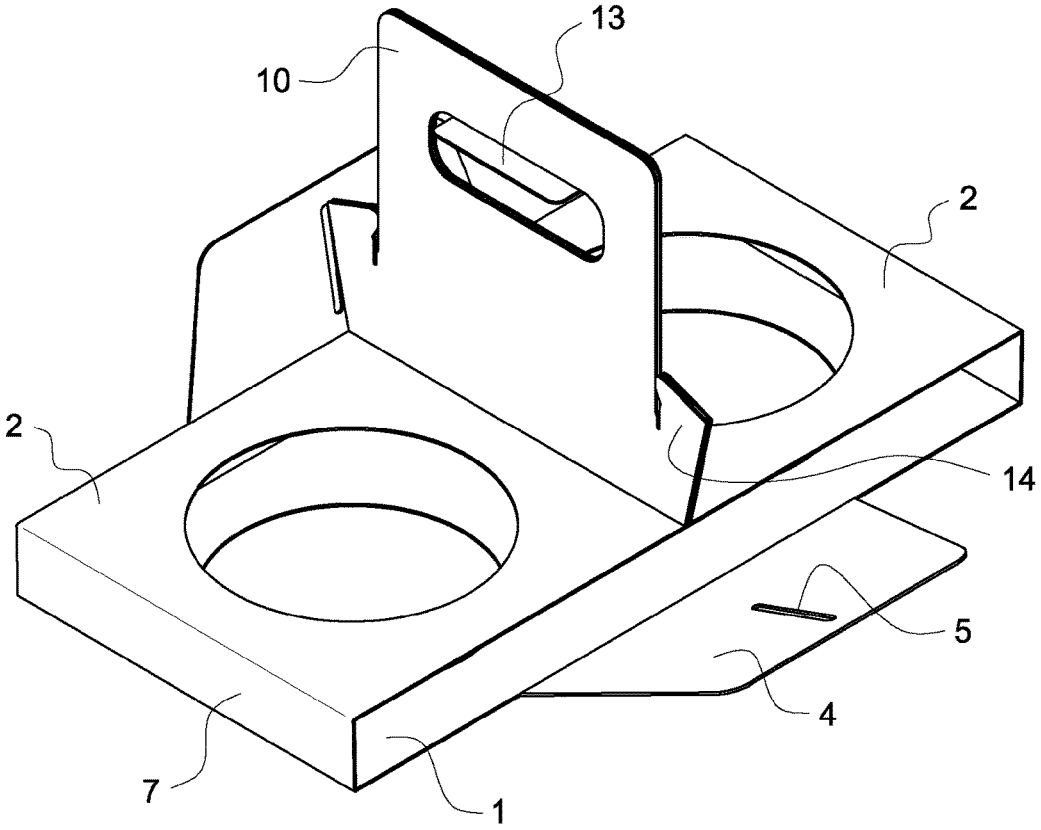
FIGS. 3 to 5 are diagrams showing steps for folding the cup holder according to the invention.
Figure 4:
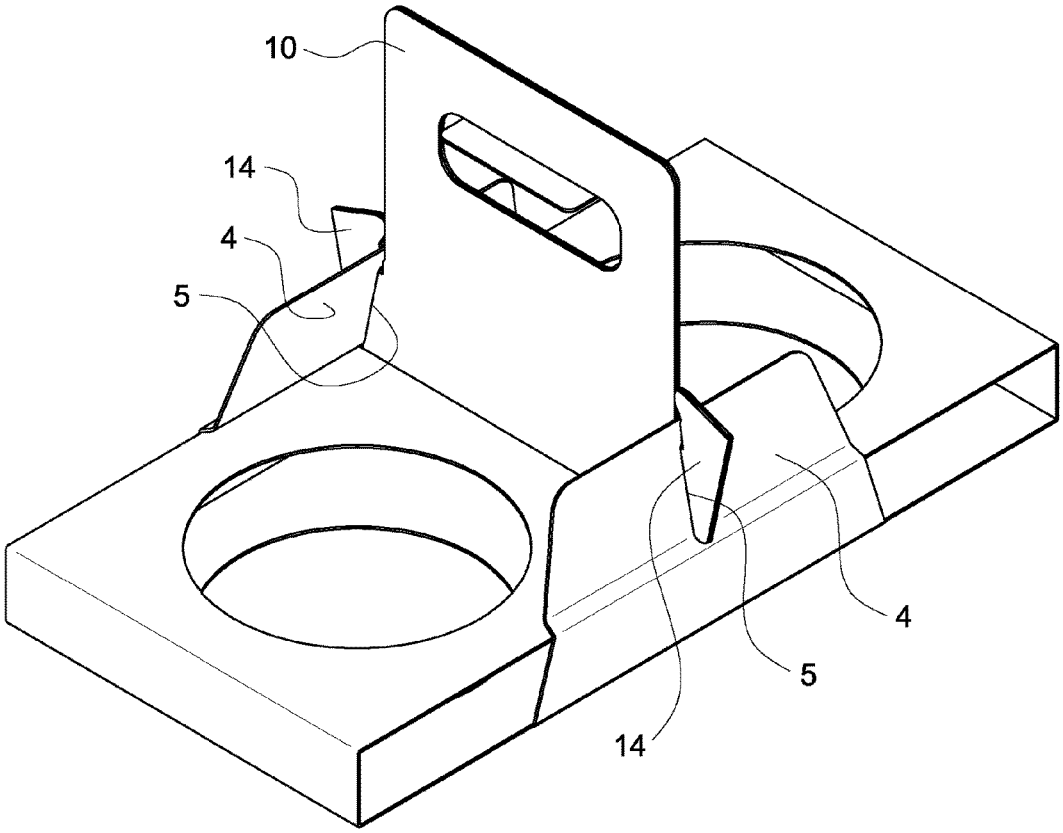

FIG. 3 shows a shape when making the rising portion 7 by folding the first, second, and third folding portions 16, 17, 18 and raising the handle portion 10. And the top end of the two handle portions 10 is made to hold easily by inserting through the handle hole 11 and folding the folding piece 13. FIG. 4 shows a state of folding and raising the fixing portion 4 and inserting the fixing piece 14 formed at a bottom portion of the handle portion 10 in FIG. 4 into the inserting groove 5. The fixing piece 14 has a top end portion having a shape of hook or arrow, and it won't come out easily once inserted and entered into the inserting groove 5. At this moment, if opening the top end portions of the fixing piece 14 to the right and left sides, its latching effect makes it harder for the fixing piece 14 to escape from the inserting groove 5.

Figure 5:
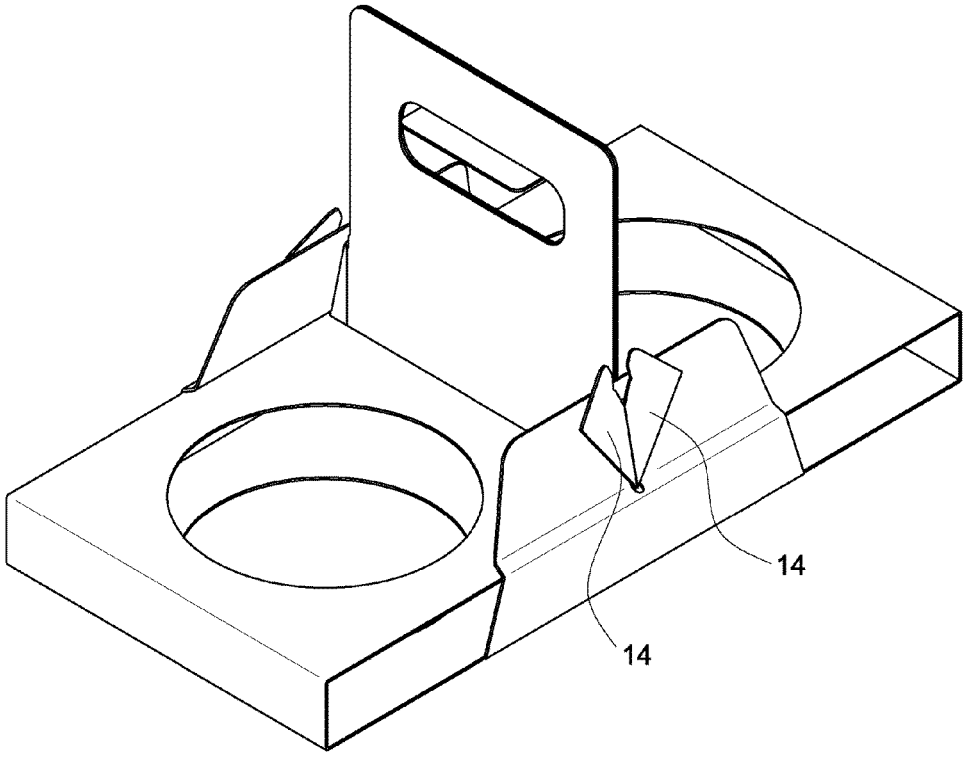

FIG. 5 shows a state of opening the fixing piece 14 to the right and left sides. Fixing is possible without opening the fixing piece 14, but in a case of using in much safer way, the fixing piece 14 can be opened to be used. That is, the user can use it alternatively.

Figure 6:
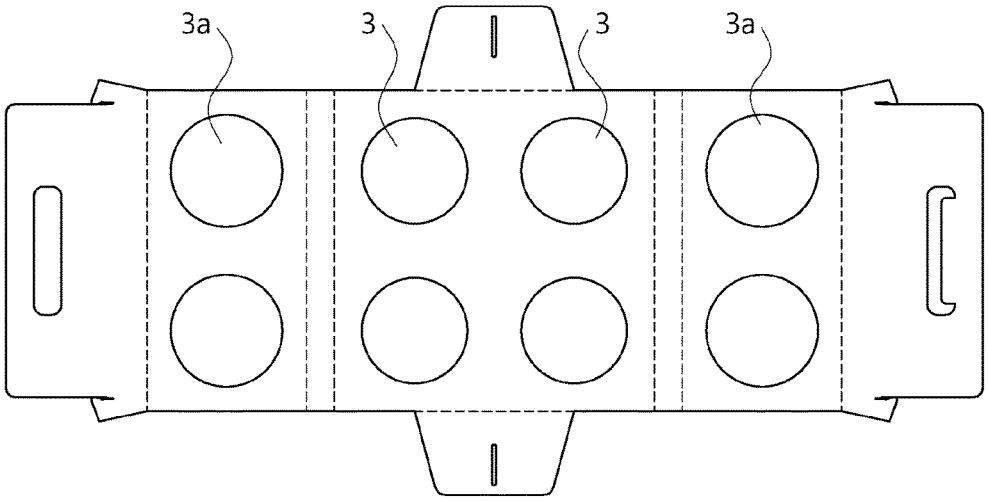
FIGS. 6 to 9 are exemplar views showing other embodiments of the invention.
Figure 7:
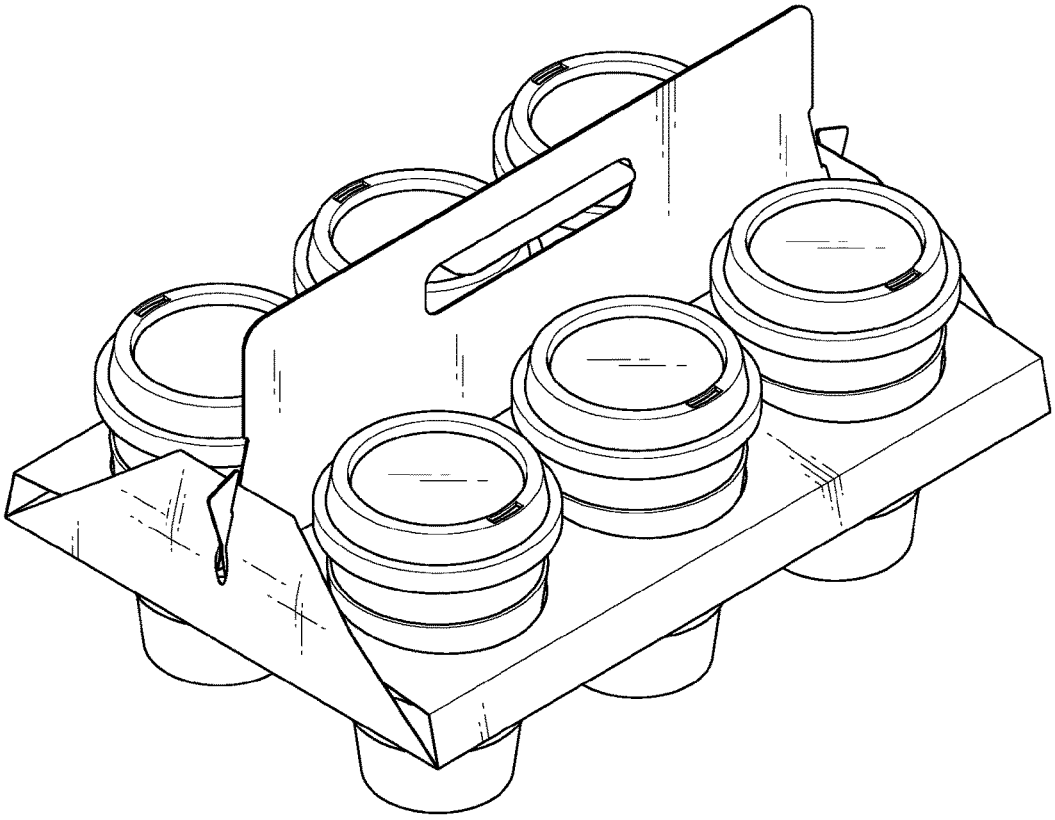
Figure 8:
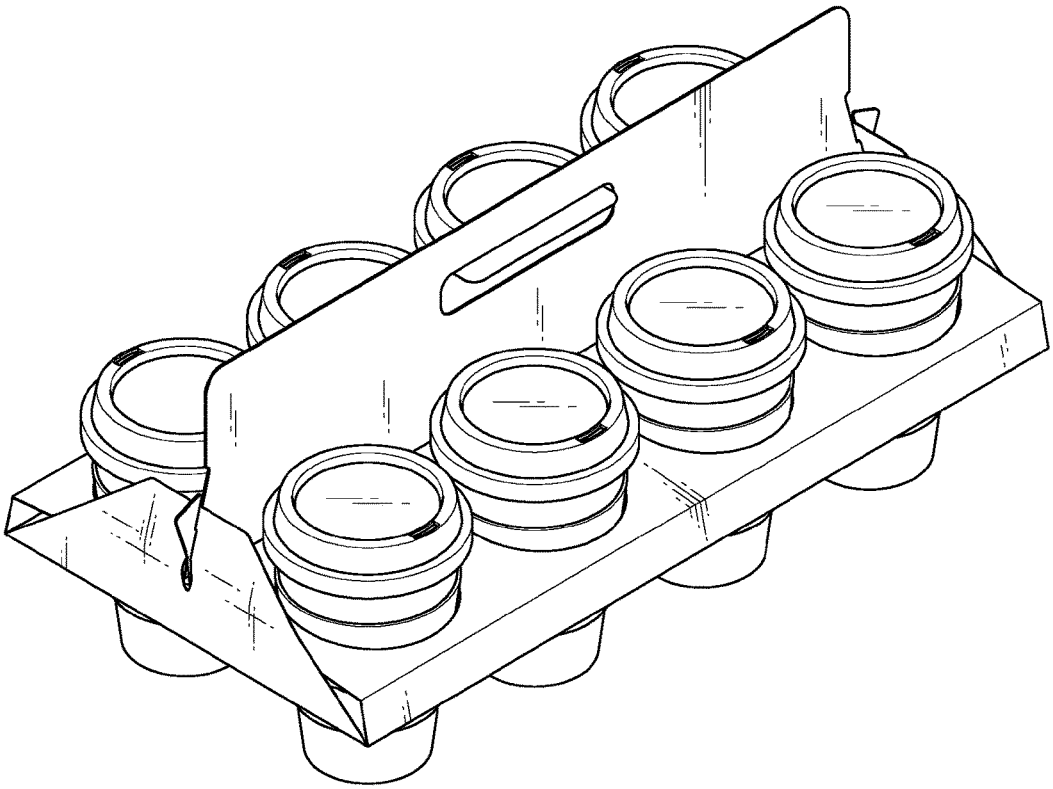

FIG. 6 is another embodiment of the invention. As shown in the figure, in this embodiment, four cups can be received. However, it is not limiting, and as shown in FIGS. 7 and 8 it can be made so that even 6 or 8 cups be received.

Figure 9:
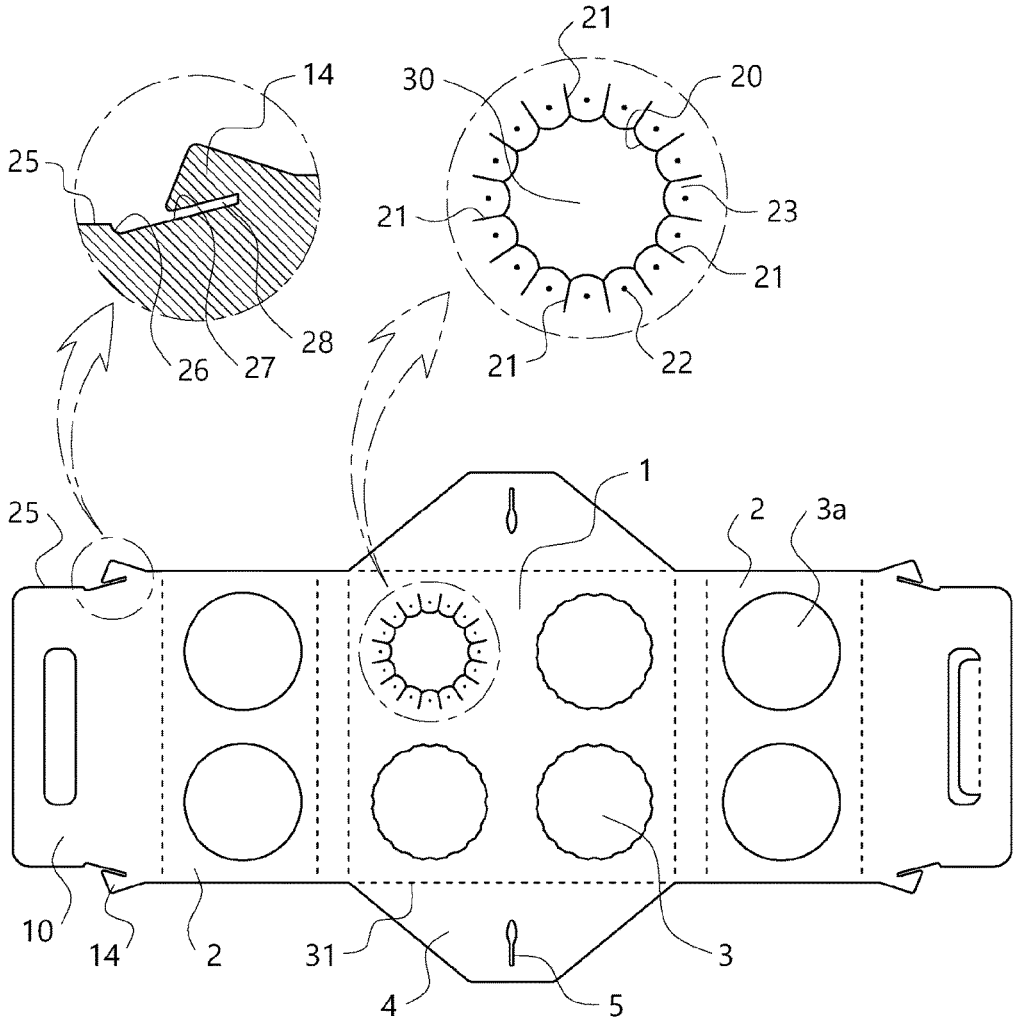

FIG. 9 is still another embodiment of the invention. In this embodiment, the cup-holding force is made stronger by forming a corrugated portions 20 on the surface forming the cup opening 3. As still another embodiment, the diameter of circle forming the corrugated portions 20 is made smaller than the diameter of the cup opening 3 of FIG. 6, making a small-diameter hole 30, and a cutting portion 21 is formed in a radial direction outside the corrugated portions 20. If configured like this, the holding force for holding the inserted cup gets larger.

As still another embodiment, between the cutting portions 21 is formed a slip-preventing surface 23. The slip-preventing surface 23 may be coating-formed using slip-preventing material such as rubber material, silicon material etc., through printing and the like. Or, instead of forming the slip-preventing surface 23, dots 22 having a protruding structure with rubber or silicon material can be formed. These provide an effect of holding the cup solidly.

On the other hand, as still another embodiment of the invention, at a bottom portion of the handle side portion 25 of the handle portion 10 may be formed a first tilted surface 26 tilting inwards and a second tilted surface 27 rising oppositely, and between the second tilted surface 27 and the fixing piece 14 is formed a fixing-piece groove portion 28. If configured like this, when inserting the inserting groove 5 of the fixing portion 4, it gets inserted smoothly as if sliding along the second tilted surface 27, and also it is possible to have a solid engagement by the first tilted surface 26 with steps and the groove structure of the fixing-piece groove portion 28, so that it would not be dislocated once engaged.

In still another embodiment of the invention, the bottom structure of the fixing portion 4 is made to contact the entire length of the bottom-surface width portion 31 of the bottom portion 1, not like as in the embodiment shown in FIG. 1. If making the bottom structure of the fixing portion 4 contact with the length of the bottom-surface width portion 31 like this, when the cup is received and the weight is loaded, since a portion of the weight loaded on the bottom portion 1 is supported by the fixing portion 4, the bottom portion 1 can be kept from sagging down.

In still another embodiment of the embodiment, in which an assembly is made by folding the top portion 2 as shown in FIGS. 4, 7, and 8, if the bottom cup opening 3 formed in the bottom portion 1 and the top cup opening 3*a* formed in the top portion 2 are configured so that they are not aligned along the same axis, forming eccentric axes, when the cup is received, the top cup opening 3*a* of the top portion 2 is distorted by the weight of the cup, which performs a function of holding the received cup more solidly.

According to the invention, as in the above, an easily-foldable and solid cup holder can be provided by folding the first, second, and third folding portions 16, 17, 18 and raising the handle portion 10 vertically, raising the fixing portion 4 vertically and inserting it to the inserting groove 5, and opening to the right and left the fixing piece 14 selectively. Also, according to the structure of the invention, material such as corrugated papers, etc. as a material of the portable cup holder can be saved a lot compared to any kinds of conventional portable cup holder. The cup holder according to the invention, is made with paper material, preferably with material of corrugated papers or cardboards, but they can be formed with other material, such as synthetic resins, of course. Such variations are interpreted to belong to the scope of the invention.

| | |
|---|---|
| 1 | bottom portion |
| 3, 3a | bottom and top cup openings |
| 4 | fixing portion |
| 5 | inserting groove |
| 7 | rising portion |
| 10 | handle portion |
| 11 | handle hole |
| 13 | folding piece |
| 14 | fixing piece |
| 16, 17, 18 | first, second, third folding portions |
| 19 | cutting portion |
| 20 | corrugated portions |
| 21 | cutting portion |
| 22 | dots |
| 23 | slip-preventing surface |

-continued

| | |
|---|---|
| 26, 27 | first, second tilted surfaces |
| 28 | fixing-piece groove portion |

The invention claimed is:

1. A portable cup holder made with minimum amount of folded material, the portable cup holder comprising:

a bottom portion (1) forming a bottom surface and through which a bottom cup opening (3) is formed;

a fixing portion (4) connected to top and bottom ends of the bottom portion (1) and folded vertically;

a rising portion (7) folded and disposed vertically at right and left ends of the bottom portion (1);

a top portion (2) connected to the rising portion (7) forming a top surface and forming a top cup opening (3*a*); and a handle portion (10) folded vertically upwards at the top portion (2) and forming a handle, wherein in the fixing portion (4) is formed an inserting groove (5), wherein in a bottom portion of the handle portion (10) is formed a fixing piece (14), and wherein the fixing piece (14) is configured to be inserted into the inserting groove (5) of the folded fixing portion (4).

2. The portable cup holder of claim 1, wherein in the inserting groove (5) is formed a cutting portion (19) extending outwards to an outside of the inserting groove (5).

3. The portable cup holder of claim 1, wherein a circumference of the bottom cup opening (3) is configured with corrugated portions (20) having a circumferential surface of corrugated shape.

4. The portable cup holder of claim 3, wherein any one of a slip-preventing surface (23) formed by a slip-preventing material or dots (22) having protruding shapes are formed between one cutting portion (21) and another cutting portion (21).

5. The portable cup holder of claim 1, wherein when the top portion (2) is folded, center axes vertical to the top cup opening (3*a*) formed in the top portion (2) and the bottom cup opening (3) formed in the bottom portion (1) are not coincided.

6. The portable cup holder of claim 1, wherein a width length of a bottom portion of the fixing portion (4) is equal to a length of a bottom-surface width portion (31) of the bottom portion (1).

7. The portable cup holder of claim 1, wherein in the bottom portion of the handle portion (10) are formed a first tilted surface (26) bent and tilted inwards and a second tilted surface (27) extending from an end of the first tilted surface (26) and bent outwards, and wherein between the fixing piece (14) and the second tilted surface (27) is formed a fixing-piece groove portion (28) comprising an elongated groove.

* * * * *